US006357582B1

(12) United States Patent
Fischer

(10) Patent No.: US 6,357,582 B1
(45) Date of Patent: Mar. 19, 2002

(54) AMMUNITION CONTAINER

(75) Inventor: Marco Fischer, Hochwald (CH)

(73) Assignee: Müller AG Verpackungen, Münchenstein (CH)

( * ) Notice: Subject to any disclaimer, the term of this patent is extended or adjusted under 35 U.S.C. 154(b) by 0 days.

(21) Appl. No.: 09/743,512

(22) PCT Filed: Jul. 27, 1999

(86) PCT No.: PCT/CH99/00349

§ 371 Date: Jan. 11, 2001

§ 102(e) Date: Jan. 11, 2001

(87) PCT Pub. No.: WO00/06967

PCT Pub. Date: Feb. 10, 2000

(30) Foreign Application Priority Data

Jul. 27, 1998 (CH) ..... 1581/98

(51) Int. Cl.[7] ..... F42B 39/00
(52) U.S. Cl. ..... 206/3; 206/509
(58) Field of Search ..... 206/3, 317, 503, 206/509, 521, 525, 821; 220/4.21; 89/34, 36.01, 36.05

(56) References Cited

U.S. PATENT DOCUMENTS

| | | | | | |
|---|---|---|---|---|---|
| 2,308,480 | A | * | 1/1943 | Abbott et al. | 206/3 |
| 4,279,339 | A | * | 7/1981 | Gotter | 206/3 |
| 4,356,913 | A | * | 11/1982 | Moraine | 206/3 |
| 4,598,623 | A | * | 7/1986 | Hersemeyer et al. | 206/3 |
| 4,785,930 | A | * | 11/1988 | Fischer et al. | 206/3 |
| 5,779,031 | A | * | 7/1998 | Moraine et al. | 206/3 |
| 6,019,217 | A | * | 2/2000 | Melan et al. | 206/3 |

* cited by examiner

*Primary Examiner*—Luan K. Bui
(74) *Attorney, Agent, or Firm*—Nath & Associates PLLC; Gary M. Nath

(57) ABSTRACT

The ammunition container (1) is formed in a special way and comprises a stackable outer container (2), which is provided with a reinforcing frame (20) in the region of a hinged lid (15), the reinforcing frame (20) projecting beyond the hinged lid (15) with its closing lever (16). The ammunition container (1) comprises an inner packaging (8), which encompasses an adapter part (12) and an inner sleeve (10). This adapter part (12) co-operates in the form of a locking mechanism with the inner sleeve (10) and enables an ammunition body (7) to be easily introduced, secured in its packaged position (S) and removed again.

19 Claims, 6 Drawing Sheets

AMMUNITION CONTAINER

The invention relates to an ammunition container according to the preamble of Claim 1 and an inner packaging for this container.

Ammunition containers of this kind are known, for example, from CH 679 181 and are used in barrels or ammunition batteries, in which a large number of ammunition containers are stacked on a load-bearing pallet with the intention of saving as much space as possible. These load-bearing pallets are generally of standard dimensions determined for a transport vehicle, thus predetermining the stacking volume available for the highest possible number of ammunition containers.

These known ammunition containers comprise a cylindrical container for each ammunition unit, the chamber of which container has inner support elements, for example of a foamed plastics material, cardboard or rubber, for the ammunition which is to be transported.

DE 195 14 988 and DE 197 48 829 present support elements of a known type for ammunition in ammunition containers. In these cases the ammunition is held in an inner push-in sleeve over the entire length, the projectile nose being surrounded by an insert which holds the ammunition in a central position along the longitudinal axis of the container with a further inner push-in sleeve and an adapter part.

An essential object of an ammunition container is to safely transport the ammunition from one place to another, which presupposes that the ammunition can be easily admitted to and removed from the ammunition container, and that the ammunition is protected during transport. This object must also be guaranteed following the action of mechanical stresses.

A disadvantage of known ammunition containers is the fact that, although the ammunition supported in these is surrounded by a protective container, the actual ammunition container is not always equal to the high mechanical stresses which may act from outside. Thus impacts as occur if the container is dropped, for example, may damage a hinged lid closing the ammunition container such that it can no longer be operated. Although the ammunition may then still be functional, it can no longer be removed from the container. Similar limitations in operability may also occur if the circumferential surface of the ammunition container undergoes substantial deformation.

Modern ammunition containers must therefore not only be safely stacked, but must also remain functional after being dropped onto the lid from a height of 2.5 m. Moreover, the ammunition should not automatically detonate if the loaded container is dropped from 12.5 m. As regards the thermal resistance of an ammunition container, this is required to resist burning at 800° C. undamaged over 5 minutes. In this case the adverb "undamaged" covers both the actual ammunition container and the ammunition stored in the latter. Ammunition containers should also be able to resist the penetration of small-calibre projectiles.

A further disadvantage lies in the fact that known ammunition containers are difficult to load and unload.

The object of the invention is therefore to provide an advantageous ammunition container. A particular aim is to develop the ammunition container of the type initially mentioned such that it remains functional under mechanical and thermal stresses acting from outside. The ammunition container should also be easy to load and unload. A further particular aim is to provide a stackable ammunition container which can be efficiently manipulated and easily opened even after being dropped onto the lid.

This object is solved according to the invention by an ammunition container having the features of Claim 1 and/or 12. The subclaims 2 to 11 and 13 to 21 relate to further, advantageous embodiments. The ammunition container consists in particular of a stackable outer container and an inner container. An essential feature lies in the fact that the outer container is provided with a reinforcing frame which projects beyond a hinged lid which is disposed at the front side of the ammunition container and has a closing lever. The reinforcing frame therefore surrounds the hinged lid with closing lever to protect it against mechanical damage.

The reinforcing frame prevents mobile parts of the ammunition container from undergoing mechanical deformation and damage, as may occur if it is dropped onto the lid region. The hinged lid thereby remains fully operable even following substantial mechanical stresses.

The possibility of unloading the containers also remains unaffected by any deformation of the ammunition container. For this purpose the inner tube is just connected to the outer container at its front side and at its bottom, so that deformations of the outer container do not also cause deformation of the inner tube.

A particularly advantageous development of the invention is characterised by the fact that the hinged lid which closes the inner tube is directly articulated to the reinforcing frame according to the invention. Relative movements and positioning tolerances between the inner tube and the hinged lid can thus be accommodated by an appropriately formed seal between the hinged lid and the inner tube.

It is, moreover, of particular advantage for the closing lever to comprise lever claws which act on closing straps of the reinforcing frame. The entire hinged lid-closure thus forms a unit which is reinforced per se and is still operable after being dropped.

A pressure-compensating valve is advantageously disposed at the hinged lid for pressure equalisation purposes. The pressure-compensating valve is closed when the closing lever is in the closed state and only opens when the closing lever is opened.

In order to ensure that a large number of ammunition containers can be stacked as safely and compactly as possible, the outer container advantageously has a substantially square cross section and the upper and lower stacking faces of the ammunition container have complementary interlocking structures. The upper stacking face is in this case provided with depressions for accommodating carrying handles in a protected manner.

It is particularly advantageous for the inner tube to comprise at its inward pointing bottom face a fastening element for fastening packaging elements which directly surround the ammunition. The fastened packaging element therefore remains in the inner tube when the ammunition is removed at the place of use, thereby simplifying and accelerating the removal process.

In a further, preferred embodiment the packaging elements are configured such that it is not just the fastened packaging elements, but also—as far as possible—all the packaging elements, also called inner packaging in the following, which remain in the ammunition container when the ammunition is removed.

In a preferred embodiment the inner packaging also has a support function acting in the longitudinal direction of the ammunition container to prevent any displacement of the ammunition in the longitudinal direction during transport. It is of crucial importance, in particular if the ammunition container is dropped to prevent—or virtually prevent—the ammunition from being displaced in the longitudinal direction inside the ammunition container, in spite of the acceleration occurring. There is a risk of the ammunition automatically detonating if it is subjected to an impact on the occasion of such a displacement.

In a preferred embodiment the inner packaging is configured such that it has a closed position in which the ammunition is firmly held in the longitudinal direction and in the radial direction and such that it can be changed over to a manipulating position in which the ammunition holding mechanism is released and the ammunition can be pulled out of the inner tube or out of the inner packaging. It should also be possible to reverse the procedure. For example, it should be possible to introduce the ammunition into the inner packaging when the inner packaging is in the manipulating position, and it should then be possible to change the inner packaging over into a closed position in order to firmly hold the ammunition.

A further preferred development is distinguished by the fact that the interspace between the inner tube and the outer container is filled with an absorption material. This absorption material on the one hand is used for thermal insulation purposes and on the other increases safety against the penetration of small-calibre ammunition. The ammunition container can therefore also be exposed to comparatively high temperatures or be fired on without the packaged ammunition directly suffering damage.

The ammunition container according to the invention may be provided on both sides with a hinged lid for practical use on a load-bearing standard pallet. The ammunition container is then—with appropriately adapted inner packaging elements—also suitable for transporting relatively small projectiles, which can be introduced into a container two at a time from both sides.

In a preferred embodiment the palletized ammunition containers are provided with a common bottom plate and cover plate. In this case the ammunition containers are held together by the bottom plate and the cover plate as well as further aids which may be provided, such as bands.

The invention is illustrated in detail in the following on the basis of embodiments and with the aid of the drawings, in which only the elements which are essential for an understanding of the invention are diagrammatically illustrated and in which.

Figure 5A:
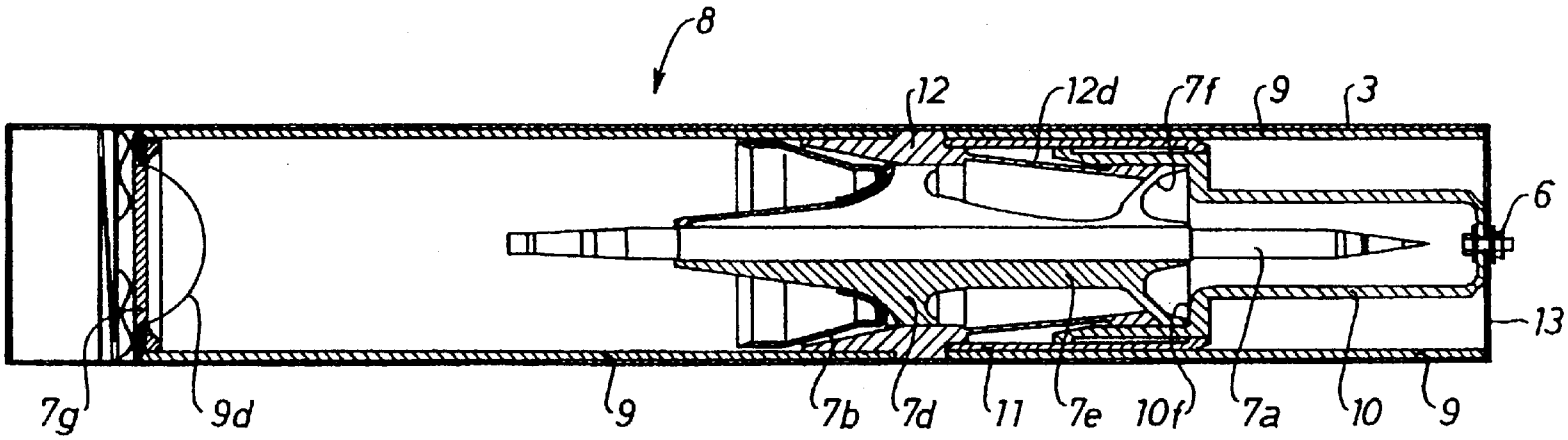
Figure 6B:
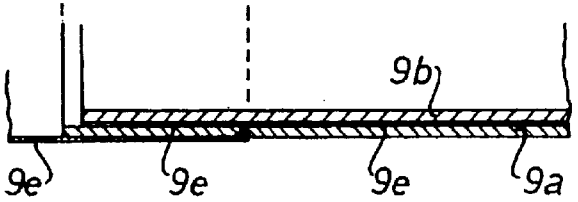
Figure 6A:
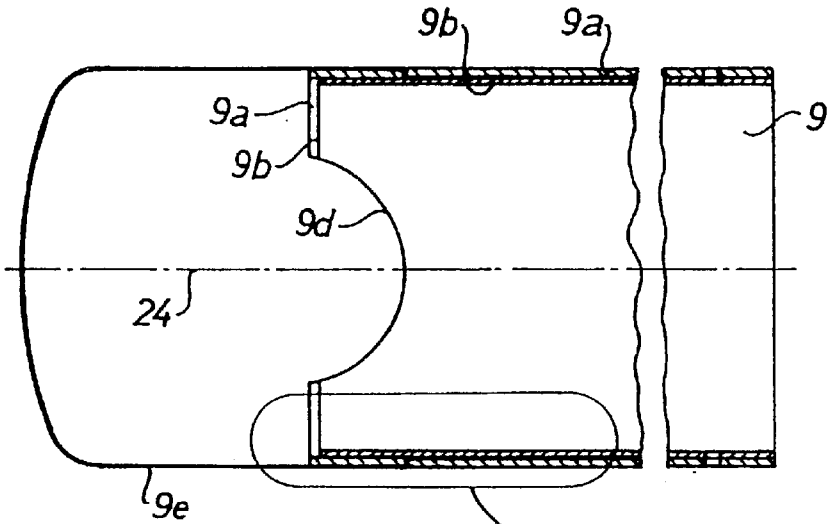
Figure 5B:
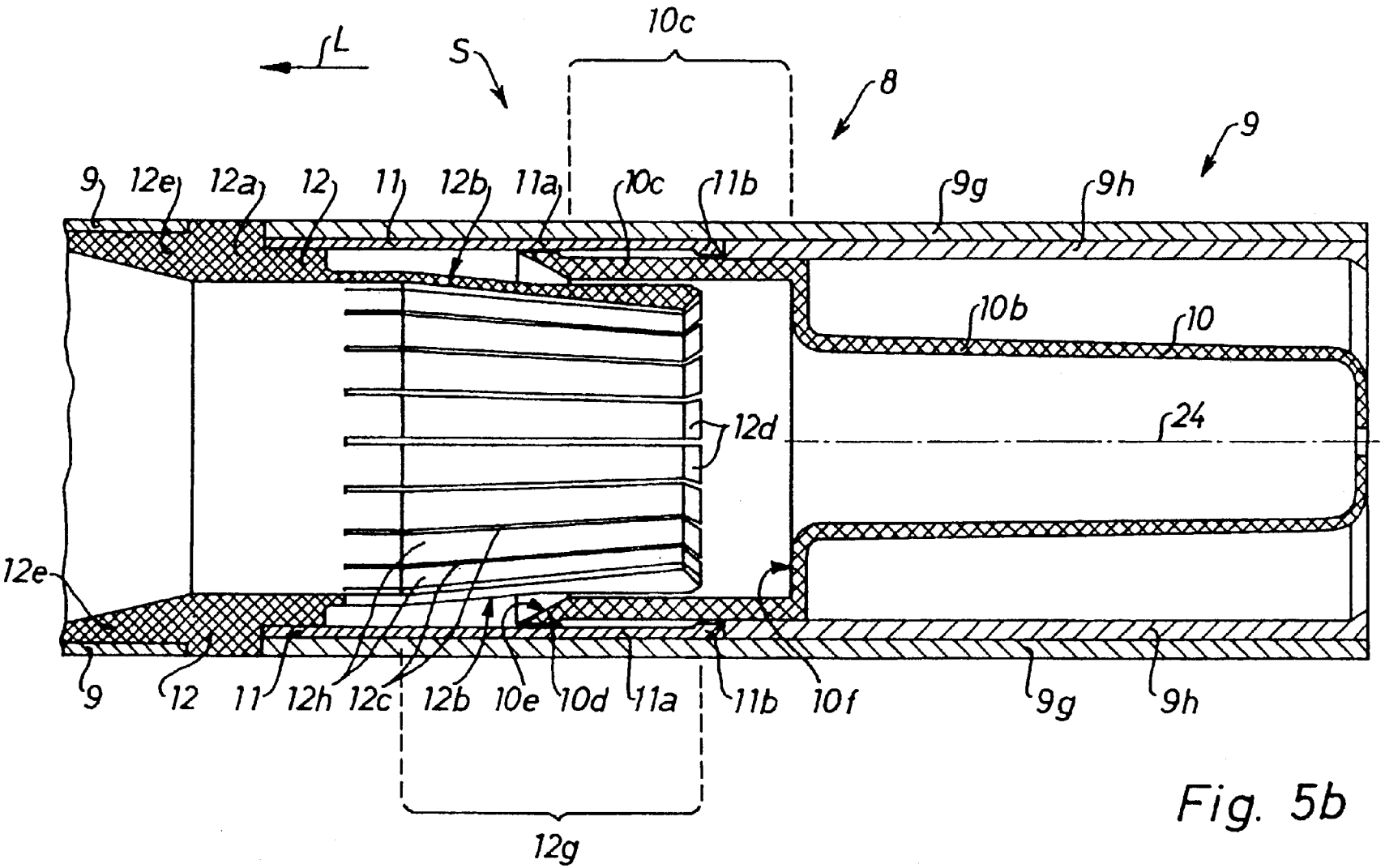
Figure 5C:
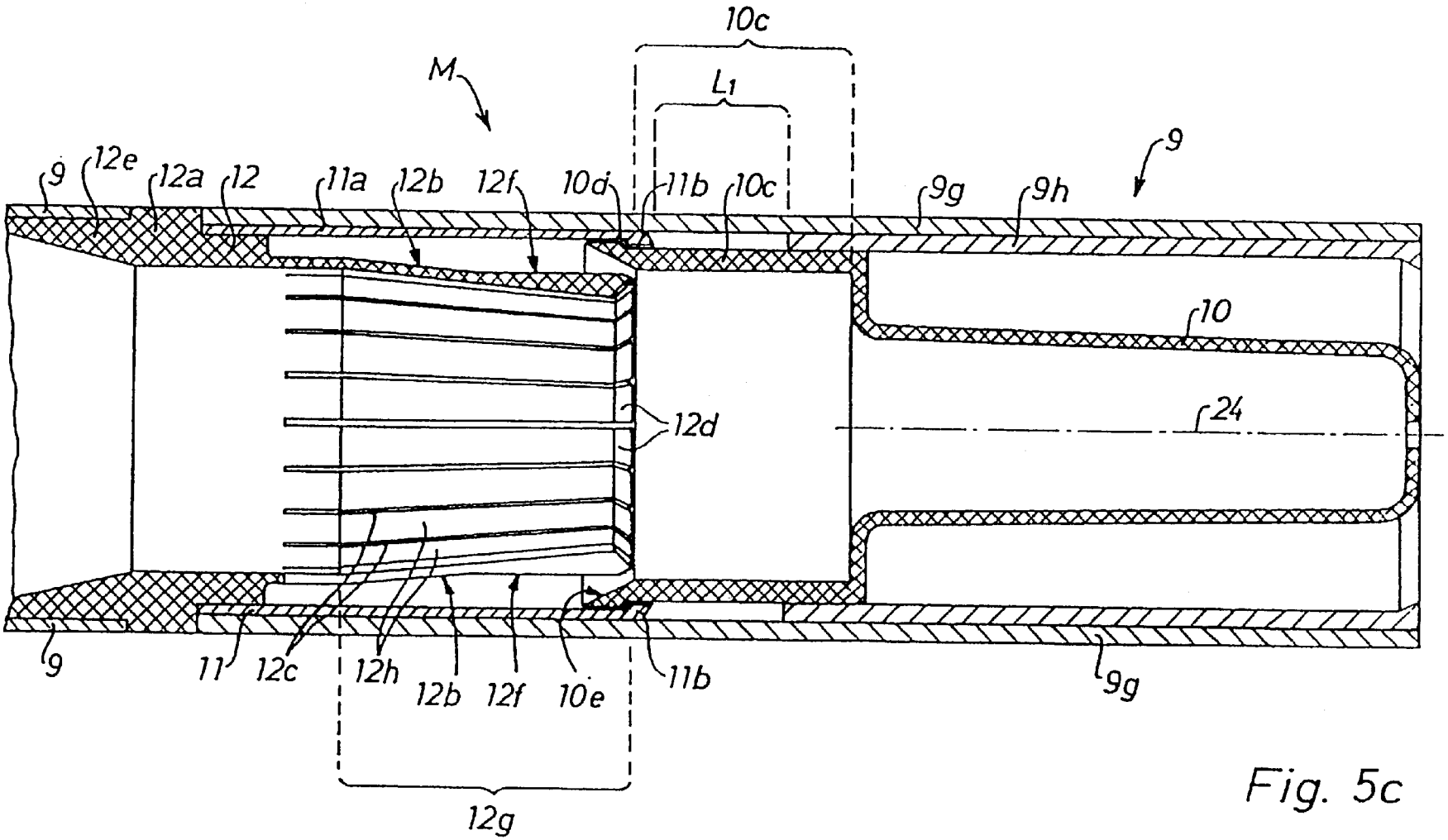

FIG. 5*a* is a longitudinal section through an inner packaging with ammunition;

FIG. 5*b* is a partial view of a longitudinal section through the inner packaging in a closed position;

FIG. 5*c* is a further partial view of a longitudinal section through the inner packaging in a manipulating position;

FIG. 6*a* is a partial view of the feed opening of the inner packaging in a longitudinal section;

FIG. 6*b* is a detail view of the feed opening with a band.

Figure 1:
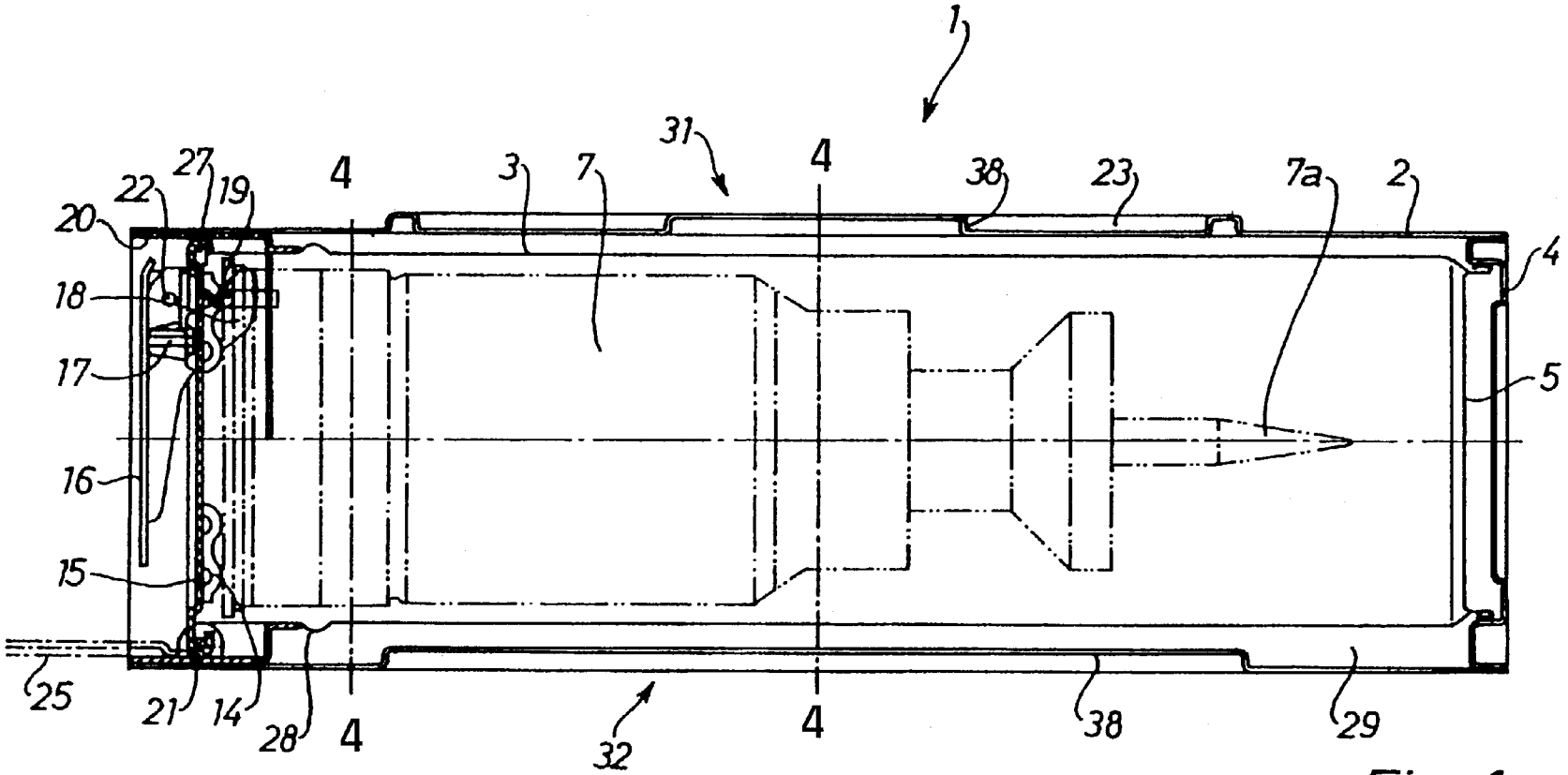
FIG. 1 is a longitudinal section through an ammunition container according to the invention without inner packaging.

In FIG. 1 the reference number 1 indicates an ammunition container according to the invention, which is loaded with ammunition 7. An inner packaging 8 with packaging elements 9 to 13 (according to FIG. 5*a*) is provided in order to hold the ammunition 7 in the ammunition container 1 along its longitudinal axis 24 in a supported manner. These packaging elements include an insert 10, which is placed over a projectile nose 7*a*. The ammunition 7 is also centered relative to the longitudinal axis 24 and aligned longitudinally by a distance sleeve 11 and a support ring 12. The ammunition 7 is surrounded over the entire length by a packaging sleeve 9 consisting, for example, of cardboard, a foamed plastics material or rubber. The packaging sleeve 9 is closed in the region of the ammunition nose 7*a* by a seamed-on sleeve bottom 13.

Packaged in this way, the ammunition 7 is placed in the ammunition container 1 according to the invention through a hinged lid 15 at the front side for transport and storage purposes. The ammunition container 1 consists of an inner tube 3, which is surrounded by a metallic outer container 2. In the preferred embodiment the inner tube 3 consists of steel of a thickness of 0.6 mm and, for reasons of weight, the outer container 2 consists of aluminium of a wall thickness of 2.5 mm. The inner tube 3 is closed by a tube bottom 5 and the outer container 2 by a container bottom 4.

Figure 3:
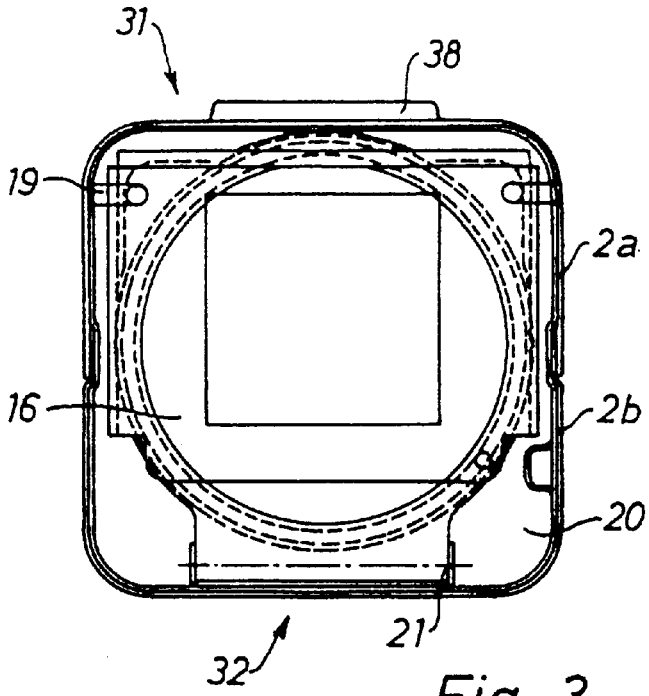
FIG. 3 is a front view of the lid region.

The inner tube 3 is connected at the bottom to the outer container via the tube bottom 5 and the container bottom 4. The inner tube 3 is provided at the front end with a circumferential bead 28 for reinforcement. Near the bead 28 a reinforcing frame 20 connects the inner tube 3 to the outer container 2. For this purpose the reinforcing frame 20 comprises towards the inner tube 3 a circular connection and is of a shape corresponding to the substantially square outer container (see FIG. 3). This arrangement of the inner tube 3 in the outer container 2 guarantees that the thermal bridges between the tube and the container will be minimal, while maintaining a construction which is mechanically extremely stable.

The reinforcing frame 20 serves to protect the entire closure arrangement of the ammunition container 1 and encompasses a hinged lid 15, which is disposed at a lid hinge 21, a lever hinge 22 and a closing lever 16. Protection against mechanical damage is guaranteed by the reinforcing frame 20 projecting at the front side of the inner tube 3 beyond the hinged lid 15 and the articulated closing lever 16 in the longitudinal direction 24. Damage to the entire closure arrangement if the container is dropped onto the latter is thus effectively prevented. The hinged lid 15 can still be manipulated even following a drop onto the closure arrangement from a height of 2.5 mm. When the hinged lid 15 is opened, it takes up the position 25 indicated by dot-dash lines in FIG. 1, and the ammunition 7 can be removed.

In th e closed position the ammunition 7 is supported against the hinged lid 15 at a resilient axial buffer 14, for example of rubber, the hinged lid 15 hermetically closing the inner tube 3 by means of a seal 27. The closing lever 16 comprises two lever claws 18, which act on two closing straps 19 for closing purposes (see also FIG. 3). The closing straps 19 are fastened to the reinforcing frame 20. The entire closure arrangement thus forms a unit, disposed at the reinforcing frame, which is protected against mechanical damage. The seal 27 is of a thickness and radial width such that small relative movements, for example due to varying thermal expansion, and positioning tolerances between the hinged lid 15 and the inner tube 3 can be reliably accommodated.

A pressure-compensating valve 17, which is covered so as to be protected by the closing lever 16, is disposed in the hinged lid 15. The pressure-compensating valve 17 may be made of a rubber stopper which is provided with a bore and is squeezed by the closing lever 16 to form a seal in the closed position. When the closing lever 16 is opened, the rubber stopper assumes its natural shape, so that the bore in the rubber stopper opens and enables pressure equalisation to take place. It is difficult or even impossible to open the ammunition container 1 if there is no possibility of pressure equalisation occurring between the ammunition container and the surrounding atmosphere.

A particular advantage lies in the fact that the double-walled design maintains the possibility of unloading the ammunition container without any limitations should the latter be deformed. For this purpose the inner tube is just connected to the outer container at its front side and at its bottom, so that deformations of the outer container do not also cause deformation of the inner tube.

Figure 4:
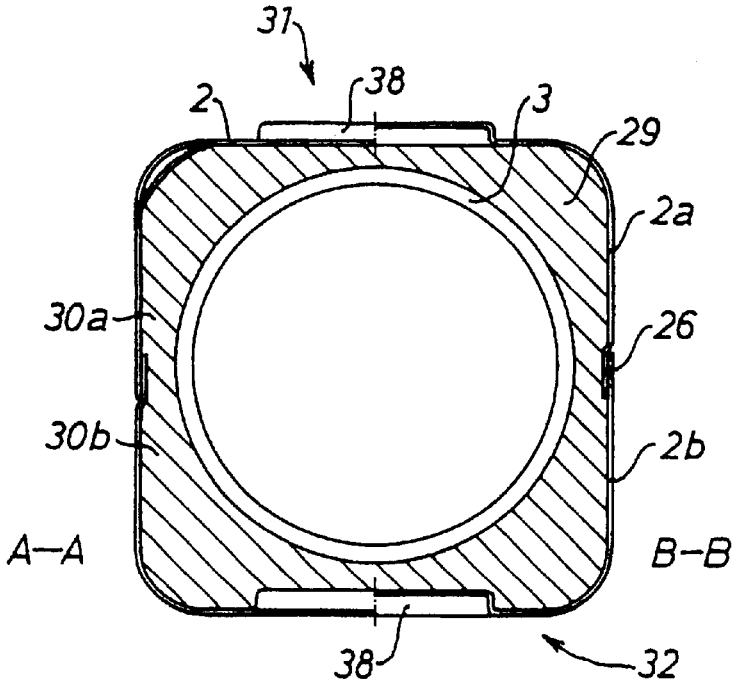
FIG. 4 is a vertical section through the ammunition container along the lines A—A and B—B in FIG. 1.

As represented in FIGS. 1 and 4, the interspace between the inner tube 3 and the outer container 2 is filled with an absorption material 29. This absorption material 29 performs a dual function. On the one hand it is used for thermal insulation purposes and on the other guarantees safety against the penetration of small-calibre ammunition. The projectile energy impacting on the absorption material 29 is dissipated here. The absorption material which is used is either foamed polyurethane or polystyrene half-shells 30*a,* 30*b,* which are placed in the outer container 2. The outer container 2 is made from two container shells 2*a,* 2*b,* which are riveted together along horizontal connecting points 26. A rivet connection is particularly advantageous here, as this at the same time guarantees reliable electrical contact between the container shells for equipotential bonding. However it is also possible to weld or bead the connecting points 26.

Because of its stable shape, the ammunition container 1 according to the invention is able to survive standard drop tests from 12.5 m without the ammunition automatically detonating. It also withstands a burning test at 800° C. over 5 minutes, without the ammunition container or the ammunition contained in it suffering any damage.

Figure 2:
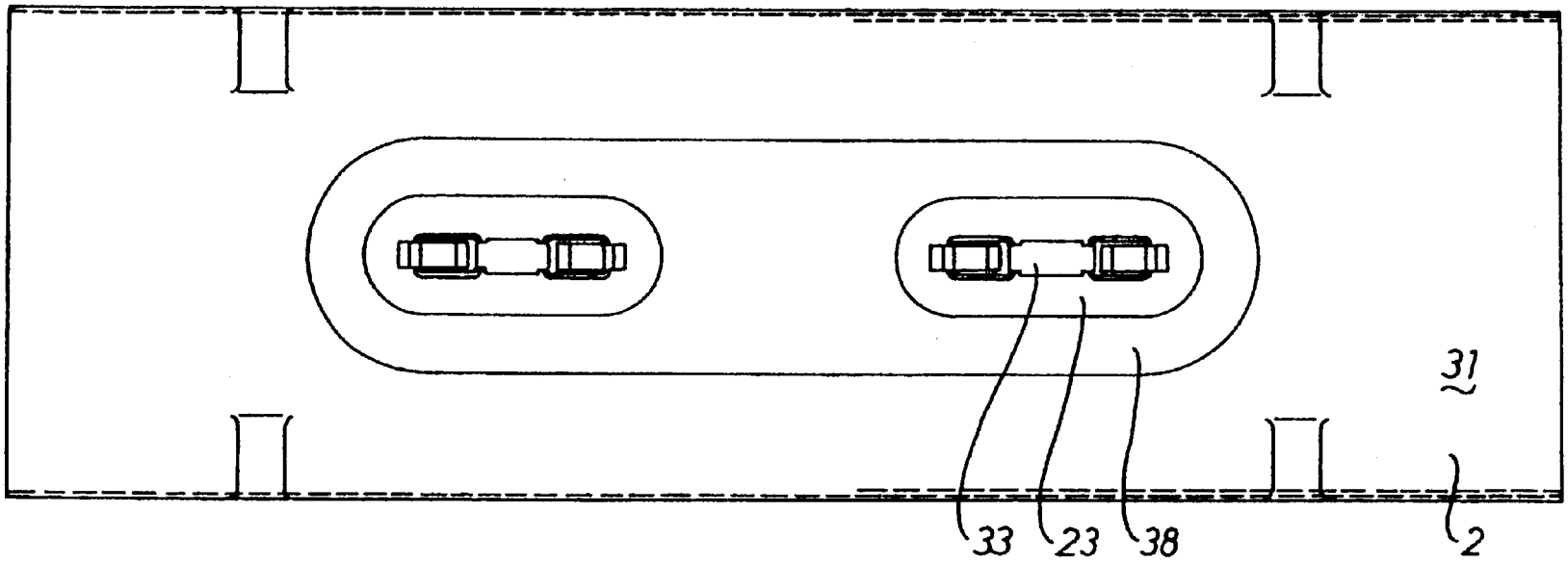
FIG. 2 is a view of an upper stacking face of the ammunition container.

In order that the ammunition container may be safely stacked, it comprises complementary interlocking structures 38 at an upper 31 and at a lower 32 stacking face, as illustrated by FIGS. 1, 2 and 4. Pull-out carrying handles 33 are disposed in depressions 23 of the interlocking structure 38 at the upper stacking face 31. The carrying handles 33 do not hamper the facility with which the ammunition containers 1 can be stacked when in the lowered, represented position and are themselves protected against mechanical damage. The carrying handles 33 are pulled back by a spring, which is not represented, so that they automatically move into the represented normal position after the container has been carried. The carrying handles 33 may also be in the form of pivotable bow-type handles. The return spring, which is not shown, causes the carrying handle 33 to automatically spring into its normal position, so that the carrying handles 33 are not a hindrance when the individual ammunition containers are stacked.

In order to remove the ammunition 7, it is particularly important for the inner tube 3 to comprise at its inward pointing bottom face a fastening element 6 for fastening packaging elements which directly surround the ammunition. The insert 10 is advantageously connected to a fastening element 6 at the sleeve bottom 13. This connection may be a snap connection or a screwed connection. The insert 10 and the other packaging elements which are fixed to it, such as the packaging sleeve 9 or the distance sleeve 11, therefore remain in the inner tube when the ammunition 7 is removed at the place of use, thereby simplifying and accelerating the removal process.

The invention is by no means restricted to the embodiments represented here. For example, it is also possible to use a double-walled ammunition container 1 which is provided with a respective hinged lid at both ends without departing from the inventive concepts. An ammunition container of this kind may then be filled with relatively small ammunition two at a time, in which case the inner packaging material must be adapted. This type of use is advantageous because the ammunition container 1 according to the invention can be safely stacked on a load-bearing standard pallet as densely as possible, i.e. with the greatest possible number of containers per volume. It is only the inner packaging elements which have to be modified in order to be able to transport a different type of ammunition in the standard ammunition container according to the invention.

It is also conceivable, for example, to replace the closing straps 19 by a punched part which is provided with slots corresponding to the engaging lever claws 18 and is to be riveted to the reinforcing frame 20.

FIG. 5*a* is a longitudinal section through a diagrammatically represented ammunition container 1 with stackable outer container 2. An inner packaging 8, encompassing the packaging elements 9, 10, 11 and 12, is disposed in the inner tube 3 and securely holds the ammunition 7, represented in a longitudinal section, both in the longitudinal direction 24 and in a direction radial to the latter. The ammunition 7 encompasses a projectile 7*a,* a cartridge 7*b,* a propellant charge case 7*c,* a flange 7*d,* a further flange 7*f,* a propellant cage 7*e* and a cartridge bottom 7*g.* The partially cylindrical inner sleeve 10 is preferably firmly connected to the tube bottom 5 or to the inner tube 3 with the aid of a fastening means 6, which is not represented in detail. The inner sleeve 10 comprises a contact edge 10*f,* against which the flange 7*f* of the ammunition 7 firmly lies. The flange 7*f* lies firmly against a plurality of lips 12*d,* which are resilient in the radial direction, at the point lying opposite in the longitudinal direction 24. The ammunition 7 is firmly held in the longitudinal direction 24 by the contact edge 10*f* and the lips 12*d.* The ammunition 7 is also held in the longitudinal direction 24 by the resilient axial buffer 14, as shown in FIG. 1. The ammunition 7 is also held radially to the longitudinal direction, inter alia, by the inner sleeve 10 via the flange 7*f* and by the adapter part 12 via the flange 7*d.*

FIG. 5*b* shows a longitudinal section of the inner packaging 8 of the arrangement according to FIG. 5*a* in detail, the ammunition 7 which is held having been omitted for the sake of clarity. The inner packaging 8 encompasses the packaging sleeve 9, the adapter part 12, the locking element 11, the inner sleeve 10 as well as a second packaging sleeve 9*g,* 9*h.* This inner packaging 8 is disposed in the inner tube 3, which is not represented. The inner sleeve 10 as well as the inner part 9*g,* 9*h* of the packaging sleeve 9 are firmly connected to the diagrammatically represented tube bottom 5 or the sleeve bottom 13. The other parts 9, 12, 11 are firmly connected together at the adapter part 12 and mounted so as to be displaceable in the longitudinal direction L. The adapter part 12 encompasses a centring portion 12*e* with a tapered inner cross section, which centres ammunition 7 which is to be introduced. The adapter part 12 also encompasses a centring sleeve 12*a* as well as elastic elements 12*h,* which adjoin the latter, extend in the longitudinal direction 24 towards the inner sleeve 10, are formed as tongues and themselves form an end portion 12*g.* These tongues 12*h* are evenly spaced over the entire, circular circumference of the adapter part 12. A slot-shaped opening 12*c* extends between the tongues 12*h.* The tongues 12 as a whole form a cylindrical or tapered body 12*b.* The tongues 12*h* can move resiliently radially to the longitudinal direction 24, whereas they have relatively rigid properties in the longitudinal direction 24. The inner sleeve 10 encompasses a first sleeve part 10*b* and a second sleeve part 10*c,* which is also called outer portion, has a greater inside diameter and ends in a boundary edge 10*d* which projects radially outwards and also comprises a run-in portion 10*e*. The inside diameter of the second sleeve part 10*c* is adapted with respect to the end portion 12*g* such that the tongues 12*h* lie against the sleeve part 10*c* over a sub-portion, or such that there is only a small spacing between the tongues 12*h* and the sleeve part 10*c*, in order to prevent any movement of the tongues 12*h* in the radial direction. The position of the inner packaging 8 represented in FIG. 5*b* is also called closed position S. The tongues 12*h* are prevented from moving radially here, and the end faces 12*d* of the tongues 12*h* form together with the contact edge 10*f* a reliable stop against displacement of the ammunition 7 in the longitudinal direction 24.

In order to remove the ammunition 7 from the inner packaging 8 or from the inner tube 3, the clench exerted on the ammunition 7 by the tongues 12*h* must be terminated. FIG. 5*c* shows the inner packaging 8 in a position which is also called a manipulating position M. The mobile parts 9, 12, 11, 9*g* of the inner packaging 8 are displaced in the direction of movement L. The cylindrical locking element 11, which is firmly connected to the adapter part 12, comprises a distance sleeve part 11*a*, at the end of which a stopper part 11*b* is disposed. The stopper part 11*b* and the boundary edge 10*d* of the inner sleeve 10 are adapted to one another such that they limit the movement of the locking element 12 in the longitudinal direction 24. The overall displacement length L1 of the locking element 12 is limited in the manipulating position M by the arrangement of the parts 11*b*, 10*d*.

As can be seen in FIG. 5*c*, the tongues 12*h* can move in the radial direction, as the end portion 12*g* is essentially disposed at a spacing from the second sleeve part 10*c* in the longitudinal direction 24 and the tongues 12*h* can move unimpeded or essentially unimpeded in the radial direction. While the inner packaging 8 remains in the represented manipulating position M, the ammunition 7 can be pulled out of the inner packaging 8 or pushed into the latter. In this case the tongues 12*h* are pushed outwards slightly in the radial direction via the flange 7*f*, so that the flange 7*f* can be pulled through the adapter part 12.

In a preferred embodiment a flexible band 9*e* is disposed at the front end of the packaging sleeve 9, as shown in a longitudinal section according to FIG. 6*a*. The inner packaging 8 is pulled out of the inner tube 3 by the displacement length L1 at the most by this hand 9*e*, as represented in FIGS. 6*a* and 6*b*. The inner packaging 8 is then at the same time changed over from the closed position S to the manipulating position M, as represented in FIGS. 5*b* and 5*c*. The packaging sleeve 9 has a semicircular recess 9*d*, as represented in FIGS. 5*a* and 6*a*. Because of the recess 9*d*, the cartridge bottom 7*g* as well as a part of the side wall of the propellant charge case 7*c* are freely accessible, so that the ammunition 7 can be taken hold of and pulled out of the inner packaging 8. In the embodiment according to FIG. 6*a* the packaging sleeve 9 is formed with two layers, an outer layer 9*a* as well as an inner layer 9*b* and/or an end portion 9*c*, with a sub-portion of the band being disposed between the layers 9*a*, 9*b*. The outer layer 9*a* projects slightly at the front side, thereby facilitating the introduction of the ammunition 7. FIG. 6*b* shows an arrangement which is particularly advantageous for loading the ammunition container 1 with ammunition 7. The band 9*e* extending between the inner and the outer layer 9*a*, 9*b* has an exit point 9*f* at which the band 9*e* comes to lie over the outer layer 9*a*. The exit point 9*f* is preferably disposed at a spacing from the front side which corresponds approximately to the displacement length L1. The spacing between the packaging sleeve 9 or the outer layer 9*a* and the inner tube 3 is very small, so that the projecting band 9*e* makes it difficult to push the packaging sleeve 9 into the inner tube 3. The spacing is preferably less than the thickness of the band 9. In a preferred embodiment the band passes through the exit point 9*f* at an angle of 90 degrees, as represented. The angle may also be smaller. In order to fill the ammunition container 1 with the ammunition 7, the latter is pushed into the inner packaging 8 in the position represented in FIGS. 6*b* and 5*c*, in which case any displacement of the inner packaging is temporarily impeded on account of the projecting band 9*e*, so that the ammunition 7 is pushed completely into the inner packaging 8. Together with the inner packaging 8, the ammunition 7 is then pushed completely into the inner tube 3 by the distance L1 with an increased expenditure of energy, as a result of which the adapter part 12 is changed over from the manipulating position M to the closed position S.

An essential advantage of this inner packaging 8 or this ammunition container 1 therefore lies in the fact that the ammunition 7 can be safely transported and that the ammunition 7 can easily be removed or loaded. Moreover, there is no requirement for any additional, in particular small loose parts, which means that the ammunition 7 can also be removed and loaded quickly and safely under the most difficult conditions.

In the embodiment according to FIGS. 5*a*, 5*b*, 5*c* the adapter part 12 comprises a plurality of resilient tongues 12*h* which are disposed in a circle and whose freedom of movement in the radial direction can be limited by the inner sleeve 10. However the person skilled in the art is familiar with a great many arrangements acting in an equivalent manner which can either be locked or are mobile in the radial direction in order thereby to produce or terminate a support function. Closing and/or locking mechanisms of this kind lie within the normal capacities of the person skilled in the art.

What is claimed is:

1. Ammunition container (1) with a hinged lid (15) for closing this ammunition container (1) at the front side, which hinged lid (15) comprises a closing lever (16) which is articulated to it, characterised in that the ammunition container (1) encompasses an inner tube (3) and a stackable outer container (2), that the outer container (2) is provided in the region of the hinged lid (15) with a reinforcing frame (20), and that the reinforcing frame (20) projects beyond the hinged lid (15) with its closing lever (16).

2. Ammunition container (1) according to claim 1, characterised in that the inner tube (3) is closed on one side by a tube bottom (5); and that the inner tube (3) is indirectly fastened to the outer container (2) via the tube bottom (5) and the reinforcing frame (20).

3. Ammunition container (1) according to claim 1 characterised in that the hinged lid (15) which closes the inner tube (3) is articulated to the reinforcing frame (20).

4. Ammunition container (1) according to claim 1, characterised in that a seal (27) is disposed between the hinged lid (15) and the inner tube (3) and is formed such that relative movements and positioning tolerances between the hinged lid (15) and the inner tube (3) are accommodated.

5. Ammunition container (1) according to claim 1, characterised in that the closing lever (16) comprises lever claws (18) which act on closing straps (19) of the reinforcing frame (20) when the hinged lid (15) is in the closed position.

6. Ammunition container (1) according to claim 5, characterised in that a pressure-compensating valve (17) is disposed at the hinged lid (15) such that it is covered by the closing lever (16).

7. Ammunition container (1) according to claim 1, characterised in that the outer container (2) has a substantially square cross section, wherein two outer faces of the outer container (2) are formed as an upper and a lower stacking face (31, 32) with complementary interlocking structures (38).

8. Ammunition container (1) according to claim 7, characterised in that at least one carrying handle (33) is disposed in at least one depression (23) of the interlocking structure (38) at the upper stacking face (31), and that a spring element acting on the carrying handle (33) is provided in particular to hold the carrying handle (33) in a home position.

9. Ammunition container (1) according to claim 1, characterised in that the inner tube (3) comprises a fastening element (6) at the side pointing towards the tube interior, and that packaging elements (9, 10, 11, 12, 13) can be fastened to the fastening element (6).

10. Ammunition container (1) according to claim 1, characterised in that the interspace between the inner tube (3) and the outer container (2) is filled with an absorption material (29).

11. Ammunition container (1) according to claim 1, characterised in that hinged lids (15) are disposed at both ends of the ammunition container (1) to close the inner tube (3).

12. Inner packaging (8) for an inner tube (3) of an ammunition container (1) according to claim 1, wherein the inner packaging (8) encompasses an adapter part (12) as well as an inner sleeve (10), wherein the inner packaging (8) has a longitudinal axis (24) and the adapter part (12) as well as the inner sleeve (10) are disposed in the direction of the longitudinal axis (24) and are mounted so as to be displaceable with respect to one another in this direction, wherein the adapter part (12) comprises an end portion (12*g*) which extends towards the inner sleeve (10) and is resilient in the radial direction, and wherein the inner sleeve (10) comprises an outer portion (10*c*) which is oriented towards the adapter part (12) and is adapted with respect to the end portion (12*g*) such that, by pushing the adapter part (12) and the inner sleeve (10) together into a closed position (S), the outer portion (10*c*) is disposed radially outside against the end portion (12*g*) in order to prevent any radial movement of the end portion (12*g*), or that, by pushing the adapter part (12) and the inner sleeve (10) apart into a manipulating position (M), the outer portion (10*c*) is essentially disposed at a spacing from the end portion (12*g*) in the direction of the longitudinal axis (24) so as not to impede a radial movement of the end portion (12*g*) through the outer portion (10*c*).

13. Inner packaging (8) according to claim 12, characterised in that the inner sleeve (10) is firmly connected to the inner tube (3).

14. Inner packaging (8) according to claim 12, characterised in that the adapter part (12) encompasses a centring sleeve (12*a*), from which elastic elements (12*h*) extend towards the inner sleeve (10), wherein the elastic elements (12*h*) are in particular formed as tongues, and wherein all elastic elements (12*h*) form the end portion (12*g*) and are in particular disposed in a cylindrical or conical manner.

15. Inner packaging (8) according to claim 12, characterised in that the adapter part (12) comprises a centring portion (12*e*) with an inside diameter which is in particular tapered, wherein the centring portion (12*e*) leads into the end portion (12*g*) or into the centring sleeve (12*a*).

16. Inner packaging (8) according to claim 12, characterised in that a locking element (11), which extends towards the inner sleeve (10), is firmly connected to the adapter part (12), and that the locking element (11) and the inner sleeve (10) comprise boundary elements (10*d*, 11*b*) which are adapted and disposed with respect to one another so as to limit a displacement of the adapter part (12) and the inner sleeve (10) with respect to one another in the direction of the longitudinal axis (24).

17. Inner packaging (8) according to claim 12, characterised in that a packaging sleeve (9) is firmly connected to the adapter part (12).

18. Inner packaging (8) according to claim 17, characterised in that a band (9*e*) is disposed at the end portion of the packaging sleeve (9) which is remote from the adapter part (12) to bring the packaging sleeve (9) into its manipulating position (M).

19. Inner packaging (8) according to claim 18, characterised in that the band (9*e*) runs over a length (L1) on the outside of the packaging sleeve (9).

* * * * *